US010211533B2

(12) United States Patent
Huang et al.

(10) Patent No.: US 10,211,533 B2
(45) Date of Patent: Feb. 19, 2019

(54) DUAL BAND PRINTED ANTENNA

(71) Applicant: PEGATRON CORPORATION, Taipei (TW)

(72) Inventors: Chun-Yen Huang, Taipei (TW); I-Shu Lee, Taipei (TW); Hung-Ming Yu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 12 days.

(21) Appl. No.: 15/487,445

(22) Filed: Apr. 14, 2017

(65) Prior Publication Data

US 2017/0331187 A1 Nov. 16, 2017

(30) Foreign Application Priority Data

May 10, 2016 (TW) ..... 105114435 A

(51) Int. Cl.

| | |
|---|---|
| ***H01Q 1/38*** | (2006.01) |
| ***H01Q 5/00*** | (2015.01) |
| ***H01Q 9/04*** | (2006.01) |
| ***H01Q 5/328*** | (2015.01) |
| ***H01Q 5/335*** | (2015.01) |
| ***H01Q 1/48*** | (2006.01) |

(Continued)

(52) U.S. Cl.

CPC ..... *H01Q 5/328* (2015.01); *H01Q 1/2291* (2013.01); *H01Q 1/38* (2013.01); *H01Q 1/48* (2013.01); *H01Q 5/335* (2015.01); *H01Q 5/378* (2015.01); *H01Q 9/0421* (2013.01); *H01Q 9/0442* (2013.01); *H01Q 9/30* (2013.01); *H01Q 13/106* (2013.01)

(58) Field of Classification Search

CPC ..... H01Q 5/328; H01Q 5/378; H01Q 9/30; H01Q 1/2291; H01Q 13/106; H01Q 1/48; H01Q 1/38; H01Q 9/0442; H01Q 5/335; H01Q 9/0421

USPC ..... 343/700 MS

See application file for complete search history.

(56) References Cited

U.S. PATENT DOCUMENTS

| | | | | |
|---|---|---|---|---|
| 7,663,551 | B2 * | 2/2010 | Nissinen | H01Q 1/243 343/700 MS |
| 9,123,990 | B2 * | 9/2015 | Ramachandran | H01Q 1/243 |

(Continued)

FOREIGN PATENT DOCUMENTS

| | | |
|---|---|---|
| CN | 202601846 U | 12/2012 |
| EP | 1401050 A1 | 3/2004 |

(Continued)

*Primary Examiner* — Jean B Jeanglaude

(74) *Attorney, Agent, or Firm* — McClure, Qualey & Rodack, LLP

(57) ABSTRACT

A dual band printed antenna that includes a metal substrate, an electrically isolated supporting element and a monopole antenna element. The metal substrate includes a slot. A side of the isolated supporting element is formed on the metal substrate. The monopole antenna element is formed on the other side of the isolated supporting element and corresponding to the position of the slot. The monopole antenna element includes a radiation part that includes a feed point and a ground part separated from the radiation part for a distance. The radiation part resonates with the slot to generate a radiation pattern of a first frequency band. The radiation part resonates itself to generate a radiation pattern of a second frequency band.

20 Claims, 11 Drawing Sheets

(51) Int. Cl.

| | |
|---|---|
| ***H01Q 13/10*** | (2006.01) |
| ***H01Q 1/22*** | (2006.01) |
| ***H01Q 9/30*** | (2006.01) |
| ***H01Q 5/378*** | (2015.01) |

(56) References Cited

U.S. PATENT DOCUMENTS

| | | | | |
|---|---|---|---|---|
| 2011/0260925 | A1* | 10/2011 | Chirila | H01Q 1/38<br>343/700 MS |
| 2015/0263430 | A1 | 9/2015 | Lin et al. | |
| 2015/0311594 | A1 | 10/2015 | Zhu et al. | |

FOREIGN PATENT DOCUMENTS

| | | | |
|---|---|---|---|
| EP | 1831955 | | 9/2007 |
| EP | 3113285 | A1 | 1/2017 |
| TW | 561647 | B | 11/2003 |
| TW | M397612 | U1 | 2/2011 |
| TW | 201218508 | A | 5/2012 |
| TW | 201411931 | A | 3/2014 |
| TW | I487204 | B | 6/2015 |

* cited by examiner

| Frequency (GHz) | | | 2400 | 2450 | 2500 | 5150 | 5350 | 5470 | 5600 | 5725 | 5850 |
|---|---|---|---|---|---|---|---|---|---|---|---|
| Average gain | Open | Inverted-F | -2.24 | -2.30 | -2.50 | -4.45 | -4.12 | -4.32 | -4.96 | -5.50 | -5.84 |
| | | Monopole | -2.62 | -2.26 | -2.13 | -5.26 | -4.71 | -4.61 | -5.14 | -4.96 | -5.00 |
| | Close | Inverted-F | -3.00 | -2.98 | -3.40 | -5.50 | -5.38 | -5.23 | -4.54 | -3.98 | -3.50 |
| | | Monopole | -5.13 | -3.86 | -2.89 | -6.22 | -5.05 | -4.43 | -4.20 | -3.77 | -3.71 |

FIG. 13

DUAL BAND PRINTED ANTENNA

RELATED APPLICATIONS

This application claims priority to Taiwanese Application Serial Number 105114435, filed May 10, 2016, which is herein incorporated by reference.

BACKGROUND

Field of Invention

The present invention relates to an antenna technology. More particularly, the present invention relates to a dual band printed antenna.

Description of Related Art

Along with the rapid development of the network technology, the electronic communication devices that are able to connect to network become indispensable in our daily life. Simultaneously, the requirements of the design of appearance and the convenience of the portability of the electronic communication devices become higher due to the popularity thereof. In general, in order to shrink the volume of the electronic communication devices, most manufacturers make improvement on the printed antenna. However, not only the adjustment and control of operation frequencies need to be taken into consideration when the electronic communication devices are modified to make improvement, but also the human resource cost spent during the manufacturing process is needed to be evaluated.

Accordingly, it is a great challenge to design shrunk printed antennas under the condition that the normal operation is not affected and manufacturing cost is lowered.

SUMMARY

The invention provides a dual band printed antenna that includes a metal substrate, an electrically isolated supporting element and a monopole antenna element. The metal substrate includes a slot. A side of the electrically isolated supporting element is formed on the metal substrate. The monopole antenna element is formed on the other side of the electrically isolated supporting element and corresponding to the position of the slot, and the monopole antenna element includes a radiation part and a ground part. The radiation part includes a feed point. The ground part is separated from the radiation part for a distance. The radiation part resonates with the slot to generate a first radiation pattern of a first frequency band and the radiation part resonates itself to generate a second radiation pattern of a second frequency band.

Another aspect of the present invention is to provide a dual band printed antenna that includes a metal substrate, an electrically isolated supporting element and an inverted-F antenna element. The metal substrate includes a slot. A side of the electrically isolated supporting element is formed on the metal substrate. The inverted-F antenna element is formed on the other side of the electrically isolated supporting element and corresponding to the position of the slot, and the inverted-F antenna element includes at least one radiation part comprising a feed point and a ground point. The radiation part resonates with the slot to generate a first radiation pattern of a first frequency band and the radiation part resonates itself to generate a second radiation pattern of a second frequency band.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows:

FIG. 13 is a diagram illustrating average antenna gains under different frequencies when different forms of slots and antenna elements are included in the dual band printed antenna in an embodiment of the present invention.

DETAILED DESCRIPTION

Figure 1A:
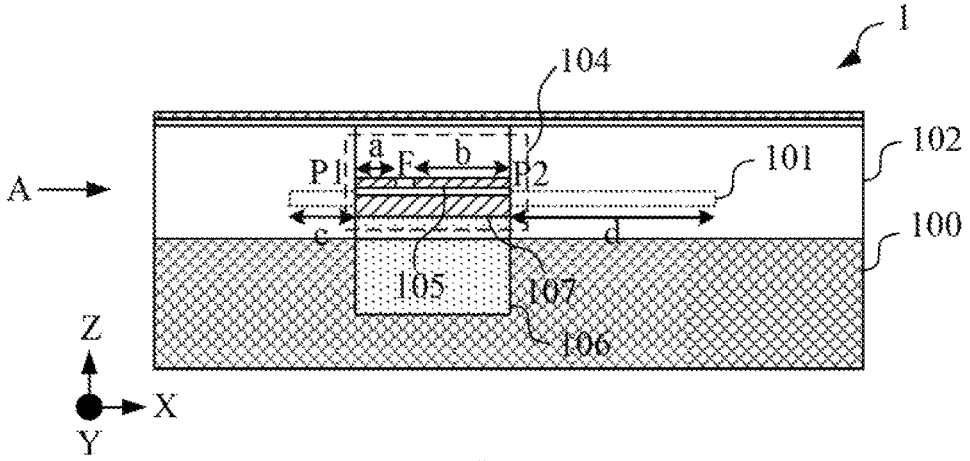
FIG. 1A is a diagram of a top view of a dual band printed antenna in an embodiment of the present invention.

Reference will now be made in detail to the present embodiments of the invention, examples of which are illustrated in the accompanying drawings. Wherever possible, the same reference numbers are used in the drawings and the description to refer to the same or like parts.

As used herein with respect to the "first", "second", . . . , etc., are not particularly alleged order or overall meaning, nor to limit the present invention, it is only the difference between the same technique described in terms elements or operations.

As used herein with respect to "electrically connected" or "coupled" may refer to two or more elements are in direct physical or electrical contact as, or as a solid or indirect mutual electrical contact, and the "power connection" can also refer to two or more elements are in operation or action.

As used herein with respect to the "including", "includes", "having", "containing", etc., are open terms that mean including but not limited to.

The term "and/or" includes the things on any or all combinations used herein.

As used herein with respect to the direction of the term, for example: up, down, left, right, front or rear, etc., only the direction reference to the drawings. Therefore, the direction of the use of terminology is used to describe not intended to limit this creation.

Certain terms used to describe the present application will be discussed below or elsewhere in this specification, in order to provide those skilled in the additional guidance on the description of the present application.

As used herein, the term on the "approximately", "about" etc., to any number of modifications or errors can change slightly, but a slight change or error does not change its nature. In general, such terms of the modified micro-scope changes or errors in some embodiments, be 20%, in some embodiments, may be 10%, and in some embodiments may be 5% or some other value. Those skilled in the art should understand that the above-mentioned value as per needs adjustment, not limited thereto.

Figure 1B:
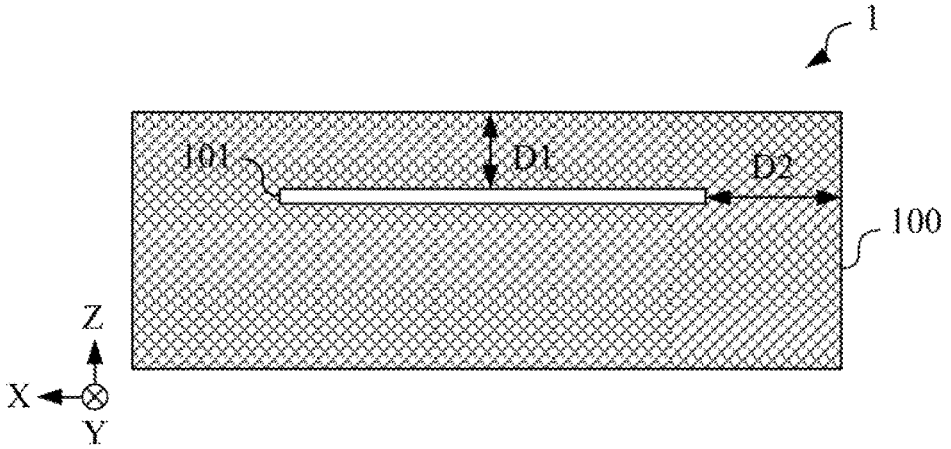
FIG. 1B is a diagram of a bottom view of the dual band printed antenna in FIG. 1A in an embodiment of the present invention.
Figure 1C:
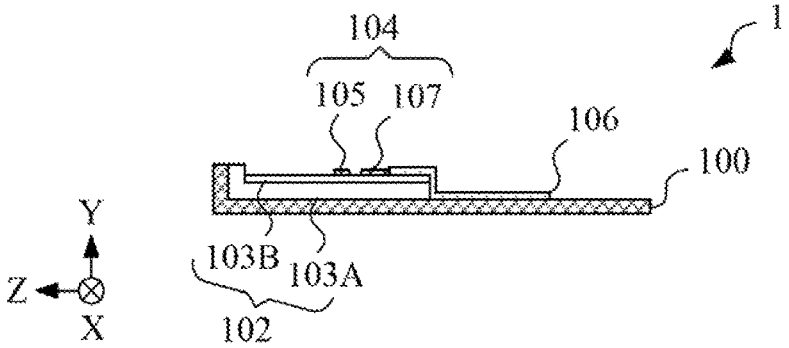
FIG. 1C is a diagram of cross-sectional view of the dual band printed antenna along a direction A in FIG. 1A in an embodiment of the present invention.

Reference is now made to FIG. 1A, FIG. 1B and FIG. 1C. FIG. 1A is a diagram of a top view of a dual band printed antenna 1 in an embodiment of the present invention. FIG. 1B is a diagram of a bottom view of the dual band printed antenna 1 in FIG. 1A in an embodiment of the present invention. FIG. 1C is a diagram of cross-sectional view of the dual band printed antenna 1 along a direction A in FIG. 1A in an embodiment of the present invention. The dual band printed antenna 1 includes a metal substrate 100, an electrically isolated supporting element 102 and a monopole antenna element 104.

The metal substrate 100 includes a slot 101 penetrating through two sides of the metal substrate 100. In the present embodiment, the slot 101 stretches along a specific direction, in which the specific direction is X direction. However, the present invention is not limited thereto. In the present embodiment, the slot 101 is a close slot. More specifically, the two terminals of the slot 101 are within the metal substrate 100.

In an embodiment, in order to maintain the structural strength of the metal substrate 100, the slot 101 is apart from two edges of the metal substrate 100 by D1 and D2, in which D1 and D2 are 9 millimeters and 15 millimeters respectively. However, the present invention is not limited thereto.

The electrically isolated supporting element 102 is formed on the metal substrate 100. In an embodiment, the electrically isolated supporting element 102 covers the slot 101. In other embodiment, the electrically isolated supporting element 102 may partially cover the slot 101.

In an embodiment, the electrically isolated supporting element 102 includes an electrically isolated supporting layer 103A and a circuit board layer 103B adjacent to each other. A side of the electrically isolated supporting layer 103A is disposed on the metal substrate 100 and the circuit board 103B is disposed at another side of the electrically isolated supporting layer 103A opposite to the metal substrate 100 such that the monopole antenna element 104 is disposed at a side of the circuit board layer 103B opposite to the electrically isolated supporting layer 103A. In an embodiment, in order to accomplish a better electrically isolating effect between the monopole antenna element 104 and the metal substrate 100 underneath and a better coupling effect between the monopole antenna element 104 and the slot 101, the thicknesses of the electrically isolated supporting layer 103A and the circuit board 103B can be 1 millimeter and 0.4 millimeters respectively. However, the present invention is not limited thereto.

The monopole antenna element 104 is formed on the electrically isolated supporting layer 103A corresponding to the position of the slot 101. The monopole antenna element 104 includes a radiation part 105 and a ground part 107.

The radiation part 105 includes a feed point F. The ground part 107 is separated from the radiation part 105 for a distance. In an embodiment, both the radiation part 105 and the ground part 107 stretch along the specific direction. However, the present invention is not limited thereto. In an embodiment, the dual band printed antenna 1 further includes a metal ground element 106 to be electrically coupled to the ground part 107 and the metal substrate 100 to aid the ground part 107 to be grounded. The metal ground element 106 can be such as, but not limited to a copper foil.

For example, the monopole antenna element 104 of the dual band printed antenna 1 can be driven to be in operation by disposing a transmission line (not illustrated) that includes a positive terminal electrically coupled to the feed point F and a negative terminal electrically coupled to the metal ground element 106 further to the ground.

When the monopole antenna element 104 is in operation, the radiation part 105 resonates with the slot 101 to generate a first radiation pattern of a first frequency band and the radiation part 105 resonates itself to generate a second radiation pattern of a second frequency band.

In an embodiment, the first frequency band has a resonant frequency of 2.4 GHz and the second frequency band has a resonant frequency of 5 GHz. More specifically, in an embodiment, the range of the first frequency band is around 2.4 GHz to 2.5 GHz. The range of the second frequency band is around 5.15 GHz to 5.875 GHz. However, the present invention is not limited thereto. When the first frequency band is around 2.4 GHz, in order to accomplish a better resonating effect between the radiation part 105 and the slot 101, the size of the slot 101 may include a length of 45 millimeters and a width of 2 millimeters. However, the present invention is not limited thereto.

In the present embodiment, a first terminal P1 and a second terminal P2 of the radiation part 105 are apart from the two terminals of the slot 101 by a length c and a length d that is larger than the length c. The feed point F is apart from the first terminal P1 and the second terminal P2 by a length a and a length b respectively. The resonant frequencies of the monopole antenna element 104 in the first frequency band and the second frequency band and the corresponding impedance matching can be adjusted by adjusting the lengths described above.

More specifically, the resonant frequency of the first frequency band can be adjusted by adjusting the lengths c and b. The impedance matching of the first frequency band can be adjusted by adjusting the length a. The resonant frequency of the second frequency band can be adjusted by adjusting the lengths c and b. The impedance matching of the second frequency band can be adjusted by adjusting the length b.

Figure 2:
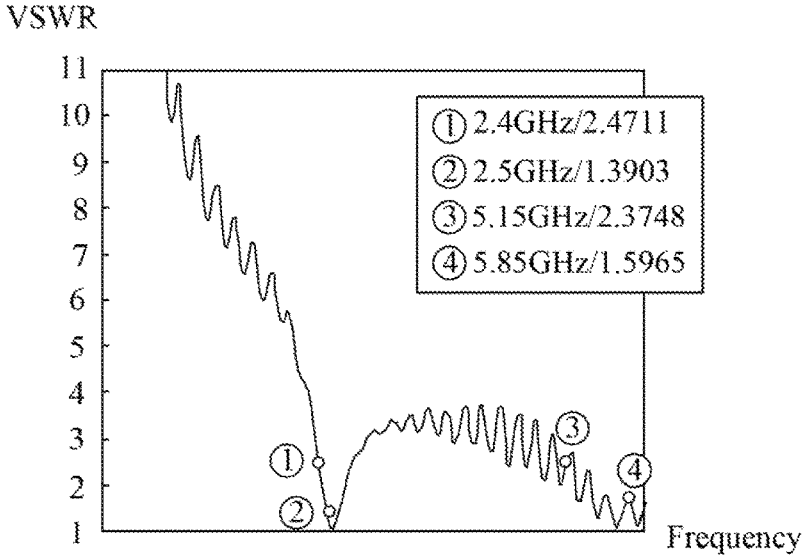
FIG. 2 is a diagram of the voltage standing wave ratio of the dual band printed antenna in an embodiment of the present invention.

Reference is now made to FIG. 2 and FIGS. 3A-3C. FIG. 2 is a diagram of the voltage standing wave ratio (VSWR) of the dual band printed antenna 1 in an embodiment of the present invention. The X-axis of the diagram stands for the frequency (unit: GHz) and the Y-axis of the diagram stands for the VSWR.

Figure 3A:
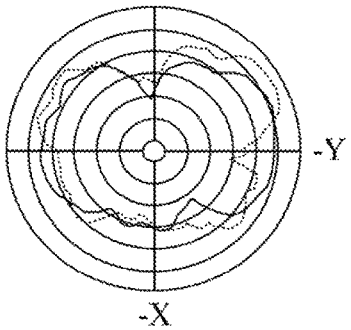
FIGS. 3A-3C are the radiation patterns of the dual band printed antenna on the X-Y plane, X-Z plane and the Y-Z plane respectively in an embodiment of the present invention.
Figure 3B:
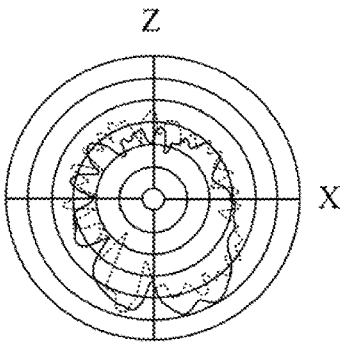
Figure 3C:
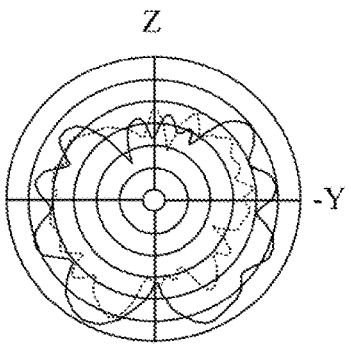

FIGS. 3A-3C are the radiation patterns of the dual band printed antenna 1 on the X-Y plane, X-Z plane and the Y-Z plane respectively in an embodiment of the present invention. The curves illustrated in thick lines are the radiation patterns of the first frequency band (2.4 GHz to 2.5 GHz) and the curves illustrated in dashed lines are the radiation patterns of the second frequency band (5.15 GHz to 5.875 GHz).

As illustrated in FIG. 2, the dual band printed antenna 1 has good VSWR performances in the first frequency band and the second frequency band. As illustrated in FIGS. 3A-3C, each of the radiation patterns of the dual band printed antenna 1 on each of planes is even.

As a result, the dual band printed antenna 1 can produce two resonant frequency bands by using the coupling of the slot 101 having a shape of a single direction and the monopole antenna element 104. The design of the slot is simplified, the structural strength and the appearance of the metal substrate 100 can be improved and the required signal transmission quality can be satisfied.

Figure 4A:
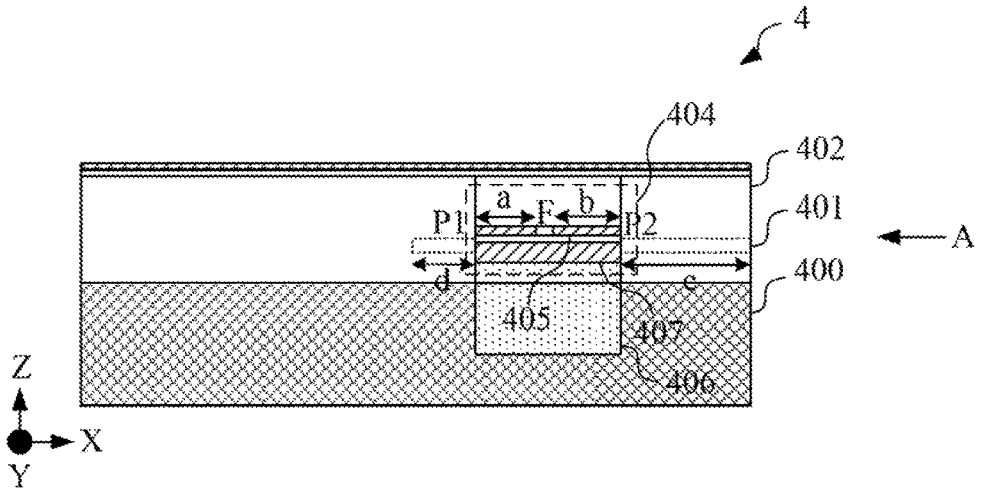
FIG. 4A is a diagram of a top view of a dual band printed antenna in an embodiment of the present invention.
Figure 4B:
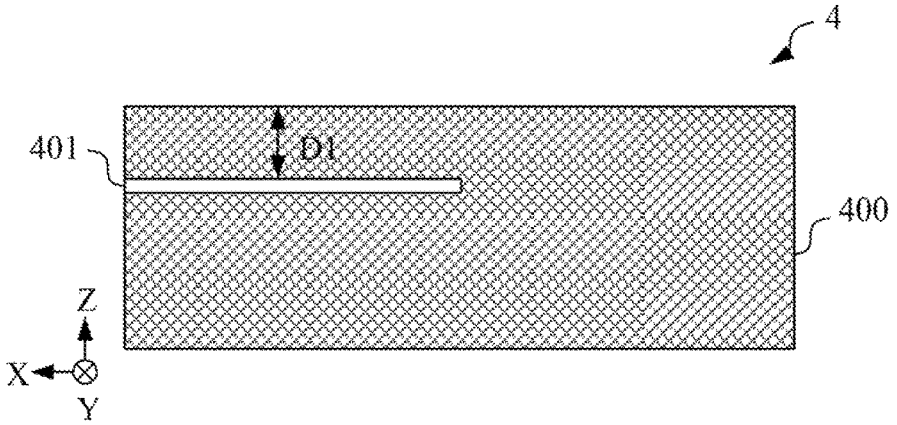
FIG. 4B is a diagram of a bottom view of the dual band printed antenna in FIG. 4A in an embodiment of the present invention.
Figure 4C:
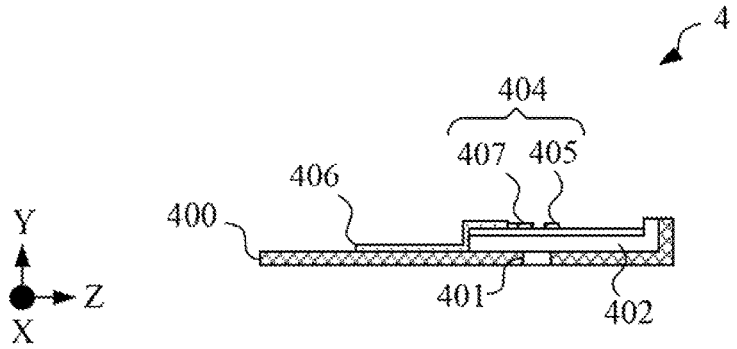
FIG. 4C is a diagram of cross-sectional view of the dual band printed antenna along a direction A in FIG. 4A in an embodiment of the present invention.

Reference is now made to FIG. 4A, FIG. 4B and FIG. 4C. FIG. 4A is a diagram of a top view of a dual band printed antenna 4 in an embodiment of the present invention. FIG. 4B is a diagram of a bottom view of the dual band printed antenna 4 in FIG. 4A in an embodiment of the present invention. FIG. 4C is a diagram of cross-sectional view of the dual band printed antenna 4 along a direction A in FIG. 4A in an embodiment of the present invention. The dual band printed antenna 4 includes a metal substrate 400, an electrically isolated supporting element 402 and a monopole antenna element 404.

The metal substrate 400 includes a slot 401 penetrating through two sides of the metal substrate 400. In the present embodiment, the slot 401 stretches along a specific direction, in which the specific direction is X direction. However, the present invention is not limited thereto. In the present embodiment, the slot 401 is an open slot. More specifically, the metal substrate 400 includes an open terminal that is open at an edge of the metal substrate 400 and a close terminal within the metal substrate 400.

In an embodiment, in order to maintain the structural strength of the metal substrate 400, the slot 401 is apart from one edge of the metal substrate 400 by D1, in which D1 is 9 millimeters. However, the present invention is not limited thereto.

The electrically isolated supporting element 402 is formed on the metal substrate 400. The structure of the electrically isolated supporting element 402 is identical to the electrically isolated supporting element 102 illustrated in FIGS. 1A-1C. As a result, the detail thereof is not described herein.

The monopole antenna element 404 is formed on a side of the electrically isolated supporting element 402 opposite to the metal substrate 400 corresponding to the position of the slot 401. The monopole antenna element 404 includes a radiation part 405 and a ground part 407. The ground part 407 can be grounded through the metal ground element 406. The structure and the operation of the radiation part 405 and the ground part 407 are identical to the radiation part 105 and the ground part 107 illustrated in FIGS. 1A-1C. More specifically, the radiation part 405 resonates with the slot 401 to generate a first radiation pattern of a first frequency band and the radiation part 405 resonates itself to generate a second radiation pattern of a second frequency band. As a result, the detail thereof is not described herein.

In an embodiment, the first frequency band has a resonant frequency of 2.4 GHz and the second frequency band has a resonant frequency of 5 GHz. More specifically, in an embodiment, the range of the first frequency band is around 2.4 GHz to 2.5 GHz. The range of the second frequency band is around 5.15 GHz to 5.875 GHz. However, the present invention is not limited thereto. When the first frequency band is around 2.4 GHz, in order to accomplish a better resonating effect between the radiation part 105 and the slot 101, the size of the slot 101 may include a length of 20 millimeters and a width of 2 millimeters. However, the present invention is not limited thereto.

In the present embodiment, a first terminal P1 and a second terminal P2 of the radiation part 405 are apart from the close terminal and the open terminal of the slot 401 by a length d and a length c. The feed point F is apart from the first terminal P1 and the second terminal P2 by a length a and a length b respectively. The resonant frequencies of the monopole antenna element 404 in the first frequency band and the second frequency band and the corresponding impedance matching can be adjusted by adjusting the lengths described above.

More specifically, the resonant frequency of the first frequency band can be adjusted by adjusting the lengths c and a. The impedance matching of the first frequency band can be adjusted by adjusting the length b. The resonant frequency of the second frequency band can be adjusted by adjusting the lengths c and a. The impedance matching of the second frequency band can be adjusted by adjusting the length b.

Figure 5:
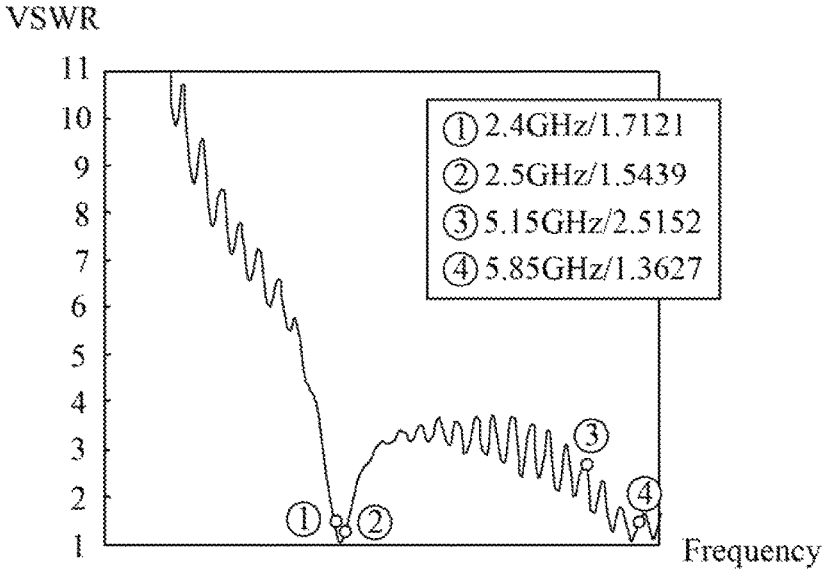
FIG. 5 is a diagram of the voltage standing wave ratio of the dual band printed antenna in an embodiment of the present invention.

Reference is now made to FIG. 5 and FIGS. 6A-6C. FIG. 5 is a diagram of the voltage standing wave ratio (VSWR) of the dual band printed antenna 4 in an embodiment of the present invention. The X-axis of the diagram stands for the frequency (unit: GHz) and the Y-axis of the diagram stands for the VSWR.

Figure 6A:
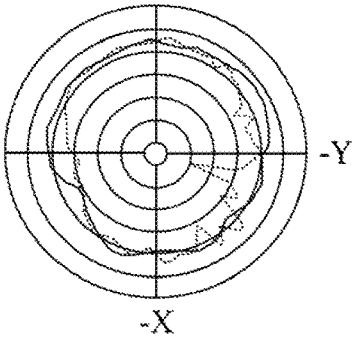
FIGS. 6A-6C are the radiation patterns of the dual band printed antenna on the X-Y plane, X-Z plane and the Y-Z plane respectively in an embodiment of the present invention.
Figure 6B:
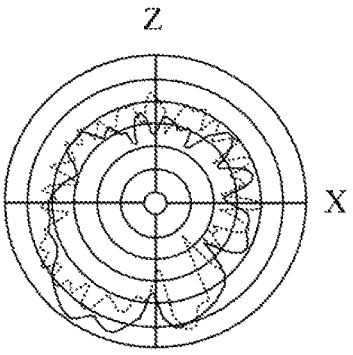
Figure 6C:
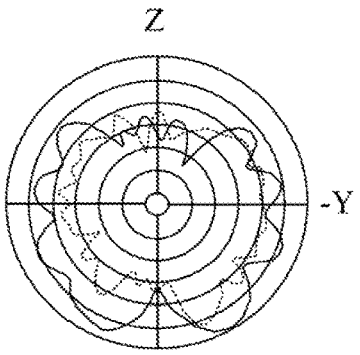

FIGS. 6A-6C are the radiation patterns of the dual band printed antenna 4 on the X-Y plane, X-Z plane and the Y-Z plane respectively in an embodiment of the present invention. The curves illustrated in thick lines are the radiation patterns of the first frequency band (2.4 GHz to 2.5 GHz)

and the curves illustrated in dashed lines are the radiation patterns of the second frequency band (5.15 GHz to 5.875 GHz).

As illustrated in FIG. 5, the dual band printed antenna 1 has good VSWR performances in the first frequency band and the second frequency band. As illustrated in FIGS. 6A-6C, each of the radiation patterns of the dual band printed antenna 1 on each of planes is even.

As a result, the dual band printed antenna 4 can produce two resonant frequency bands by using the coupling of the slot 401 having a shape of a single direction and the monopole antenna element 404. The design of the slot is simplified, the structural strength and the appearance of the metal substrate 400 can be improved and the required signal transmission quality can be satisfied.

Figure 7A:
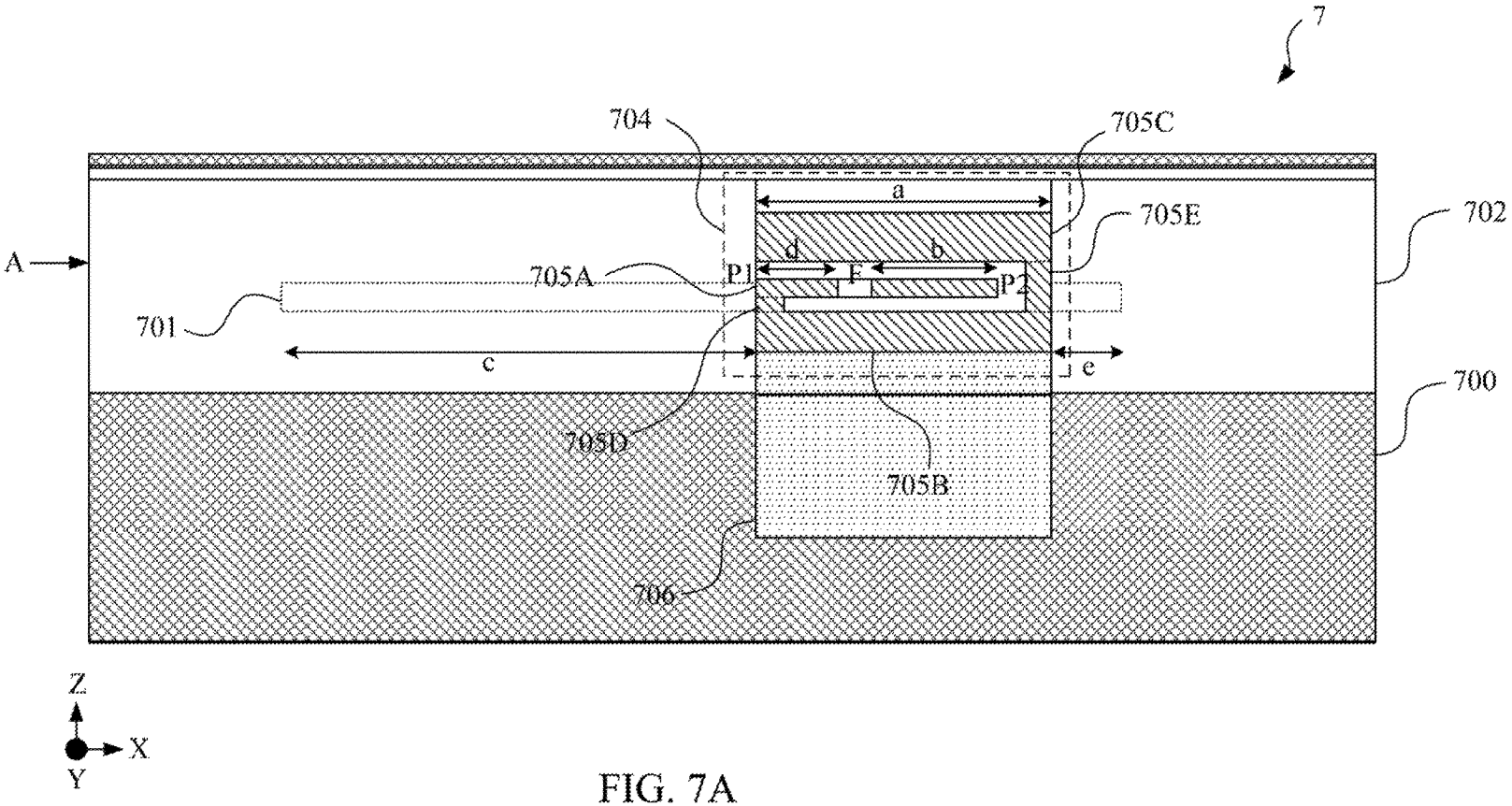
FIG. 7A is a diagram of a top view of a dual band printed antenna in an embodiment of the present invention.
Figure 7B:
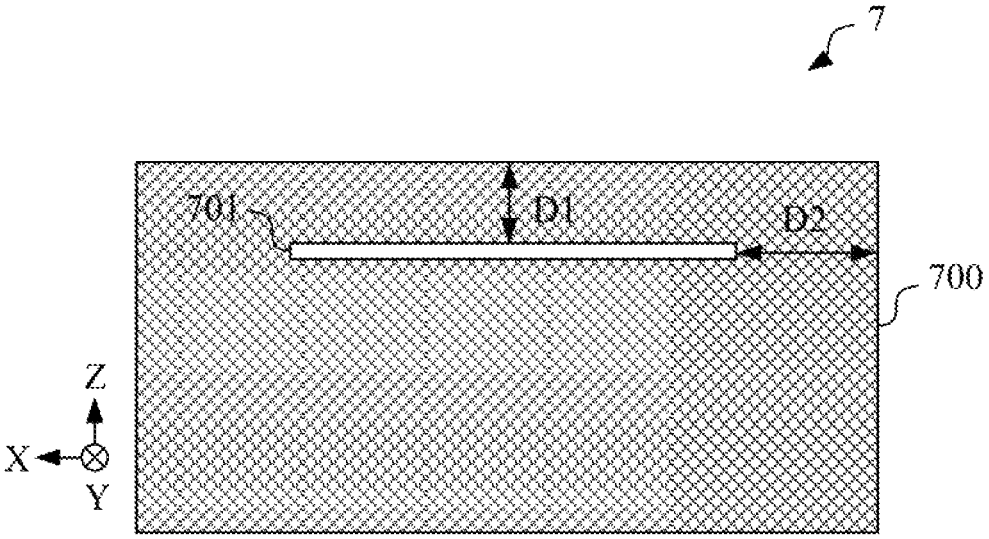
FIG. 7B is a diagram of a bottom view of the dual band printed antenna in FIG. 1A in an embodiment of the present invention.
Figure 7C:
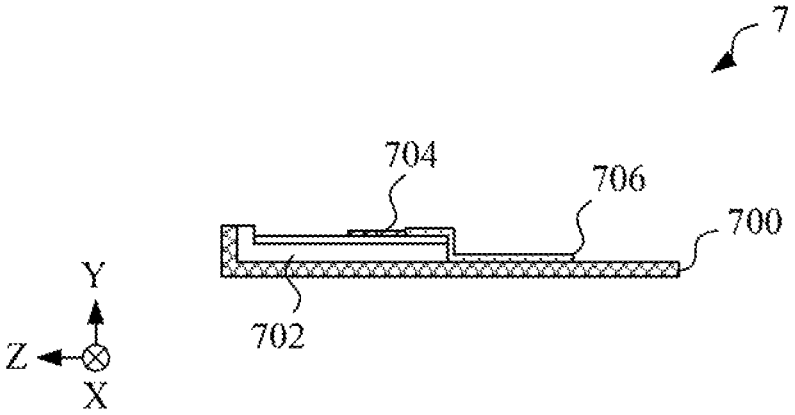
FIG. 7C is a diagram of cross-sectional view of the dual band printed antenna along a direction A in FIG. 7A in an embodiment of the present invention.

Reference is now made to FIG. 7A, FIG. 7B and FIG. 7C. FIG. 7A is a diagram of a top view of a dual band printed antenna 7 in an embodiment of the present invention. FIG. 7B is a diagram of a bottom view of the dual band printed antenna 7 in FIG. 7A in an embodiment of the present invention. FIG. 7C is a diagram of cross-sectional view of the dual band printed antenna 7 along a direction A in FIG. 7A in an embodiment of the present invention. The dual band printed antenna 7 includes a metal substrate 700, an electrically isolated supporting element 702 and an inverted-F antenna element 704.

The metal substrate 700 includes a slot 701 penetrating through two sides of the metal substrate 100. In the present embodiment, the slot 701 stretches along a specific direction, in which the specific direction is X direction. However, the present invention is not limited thereto. In the present embodiment, the slot 701 is a close slot. More specifically, the two terminals of the slot 701 are within the metal substrate 100.

In an embodiment, in order to maintain the structural strength of the metal substrate 700, the slot 701 is apart from two edges of the metal substrate 700 by D1 and D2, in which D1 and D2 are 9 millimeters and 15 millimeters respectively. However, the present invention is not limited thereto.

The electrically isolated supporting element 702 is formed on the metal substrate 700. The structure of the electrically isolated supporting element 702 is identical to the electrically isolated supporting element 102 illustrated in FIGS. 1A-1C. As a result, the detail thereof is not described herein.

The inverted-F antenna element 704 includes a first radiation part 705A, a second radiation part 705B, a third radiation part 705C and connection radiation parts 705D and 705E. The first radiation part 705A stretches along the specific direction and includes a feed point F. The second radiation part 705B stretches along the specific direction, is disposed at a first side of the first radiation part 705A, is parallel and adjacent to the first radiation part 705A and is apart from the first radiation part 705A by a first distance. The third radiation part 705C stretches along the specific direction, is disposed at a second side of the first radiation part 705A, is parallel and adjacent to the first radiation part 705A and is apart from the first radiation part 705A by a second distance. The connection radiation part 705D electrically couples a terminal of the second radiation part 705B to the first radiation part 705A and the connection radiation part 705E electrically couples the other terminal of the second radiation part 705B to the third radiation part 705C.

In an embodiment, the dual band printed antenna 7 further includes a metal ground element 706 to electrically couple to a part of the second radiation part 705B serving as a ground point to electrically couple the second radiation part 705B to the metal substrate 100 to aid the second radiation part 705B to be grounded. The metal ground element 706 can be such as, but not limited to a copper foil.

When the inverted-F antenna element 704 is in operation, the first radiation part 705A, the second radiation part 705B, the third radiation part 705C resonate with the slot 701 to generate a first radiation pattern of a first frequency band and the first radiation part 705A, the second radiation part 705B, the third radiation part 705C resonate themselves to generate a second radiation pattern of a second frequency band.

In an embodiment, the first frequency band has a resonant frequency of 2.4 GHz and the second frequency band has a resonant frequency of 5 GHz. More specifically, in an embodiment, the range of the first frequency band is around 2.4 GHz to 2.5 GHz. The range of the second frequency band is around 5.15 GHz to 5.875 GHz. However, the present invention is not limited thereto. When the first frequency band is around 2.4 GHz, in order to accomplish a better resonating effect between the first radiation part 705A, the second radiation part 705B, the third radiation part 705C and the slot 701, the size of the slot 701 may include a length of 45 millimeters and a width of 2 millimeters. However, the present invention is not limited thereto.

In the present embodiment, a first terminal P1 and a second terminal P2 of the first radiation part 705A are apart from the two terminals of the slot 701 by a length c and a length e that is smaller than the length c. The feed point F is apart from the first terminal P1 and the second terminal P2 by a length d and a length b respectively. The third radiation part 705C has a length a. The resonant frequencies of the inverted-F antenna element 704 in the first frequency band and the second frequency band and the corresponding impedance matching can be adjusted by adjusting the lengths described above.

More specifically, the resonant frequency of the first frequency band can be adjusted by adjusting the lengths c and a. The impedance matching of the first frequency band can be adjusted by adjusting the lengths d and b. The resonant frequency of the second frequency band can be adjusted by adjusting the lengths c and d. The impedance matching of the second frequency band can be adjusted by adjusting the length b.

Figure 8:
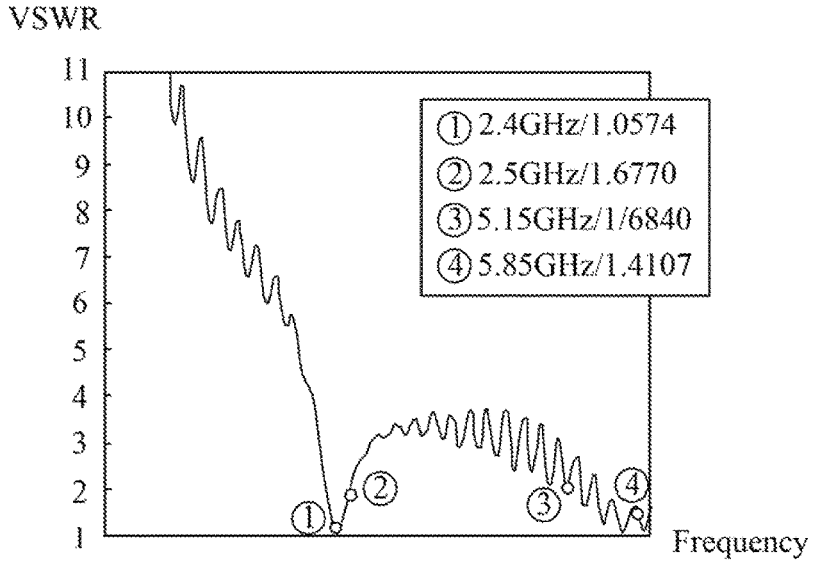
FIG. 8 is a diagram of the voltage standing wave ratio of the dual band printed antenna in an embodiment of the present invention.

Reference is now made to FIG. 8 and FIGS. 9A-9C. FIG. 8 is a diagram of the voltage standing wave ratio (VSWR) of the dual band printed antenna 7 in an embodiment of the present invention. The X-axis of the diagram stands for the frequency (unit: GHz) and the Y-axis of the diagram stands for the VSWR.

Figure 9A:
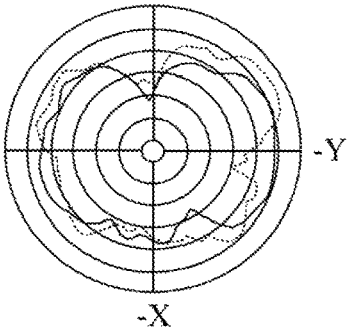
FIGS. 9A-9C are the radiation patterns of the dual band printed antenna on the X-Y plane, X-Z plane and the Y-Z plane respectively in an embodiment of the present invention.
Figure 9B:
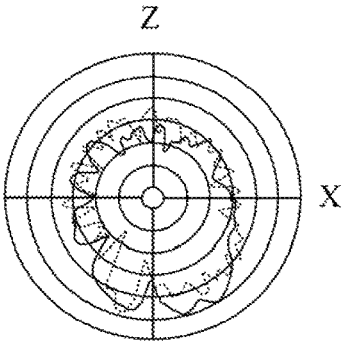
Figure 9C:
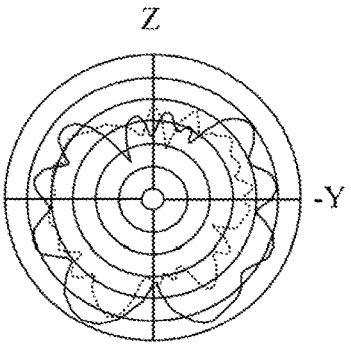

FIGS. 9A-9C are the radiation patterns of the dual band printed antenna 7 on the X-Y plane, X-Z plane and the Y-Z plane respectively in an embodiment of the present invention. The curves illustrated in thick lines are the radiation patterns of the first frequency band (2.4 GHz to 2.5 GHz) and the curves illustrated in dashed lines are the radiation patterns of the second frequency band (5.15 GHz to 5.875 GHz).

As illustrated in FIG. 8, the dual band printed antenna 7 has good VSWR performances in the first frequency band and the second frequency band. As illustrated in FIGS. 9A-9C, each of the radiation patterns of the dual band printed antenna 7 on each of planes is even.

As a result, the dual band printed antenna 7 can produce two resonant frequency bands by using the coupling of the slot 701 having a shape of a single direction and the inverted-F antenna element 704. The design of the slot is simplified, the structural strength and the appearance of the metal substrate 700 can be improved and the required signal transmission quality can be satisfied.

Figure 10A:
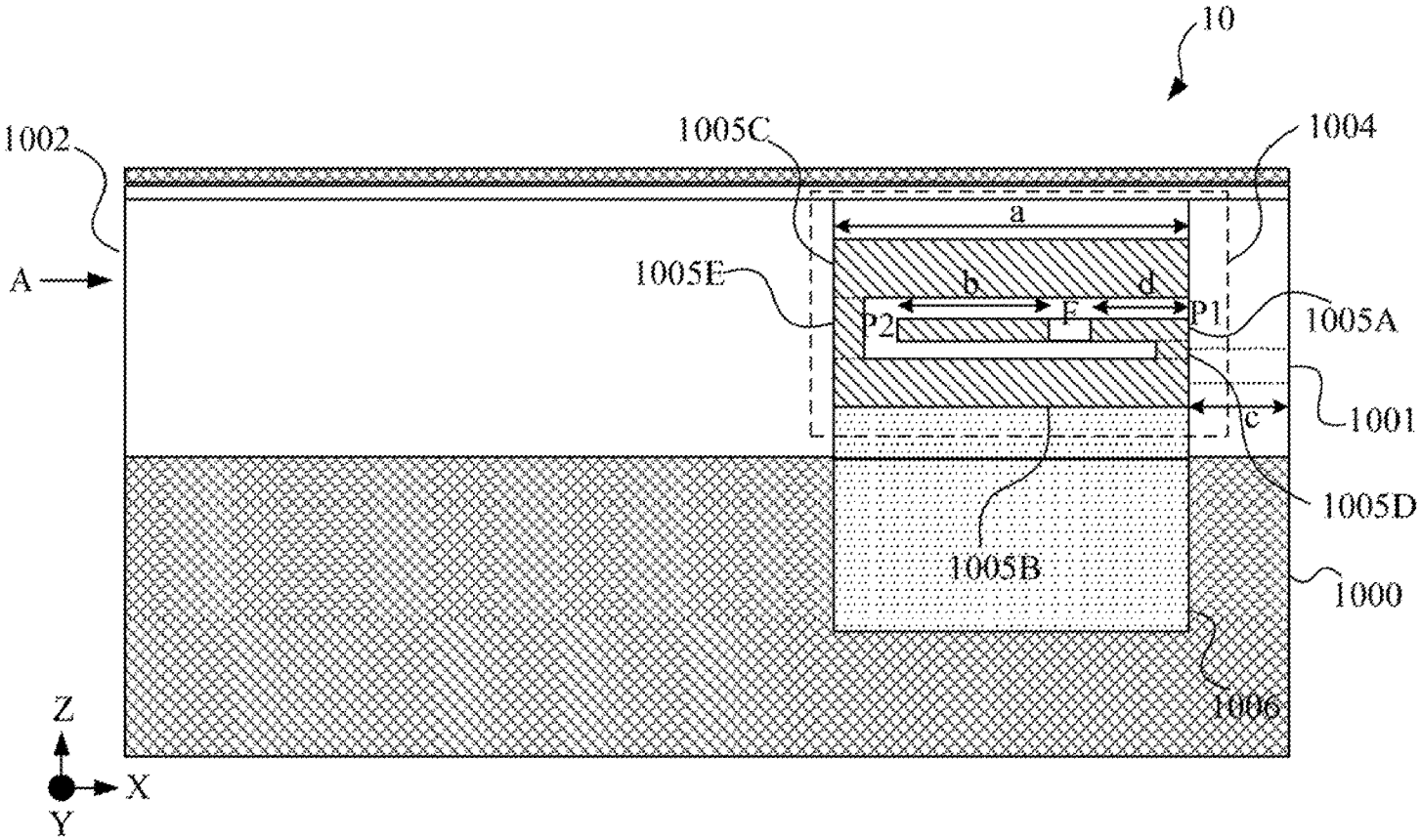
FIG. 10A is a diagram of a top view of a dual band printed antenna in an embodiment of the present invention.
Figure 10B:
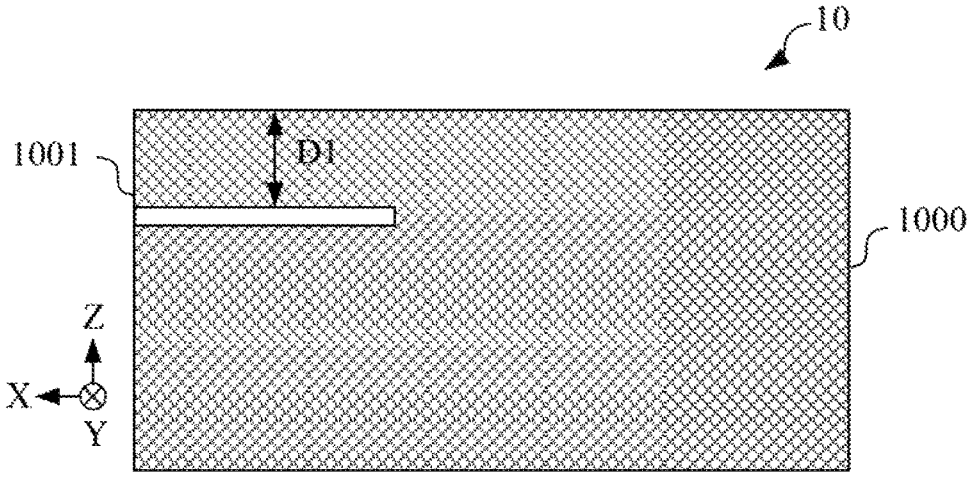
FIG. 10B is a diagram of a bottom view of the dual band printed antenna in FIG. 10A in an embodiment of the present invention.
Figure 10C:
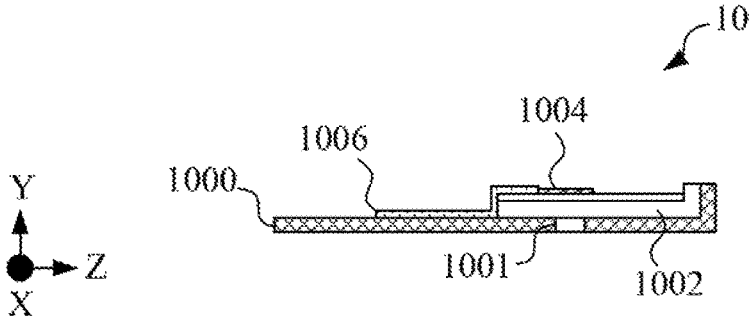
FIG. 10C is a diagram of cross-sectional view of the dual band printed antenna along a direction A in FIG. 10A in an embodiment of the present invention.

Reference is now made to FIG. 10A, FIG. 10B and FIG. 10C. FIG. 10A is a diagram of a top view of a dual band printed antenna 10 in an embodiment of the present invention. FIG. 10B is a diagram of a bottom view of the dual band printed antenna 10 in FIG. 10A in an embodiment of the present invention. FIG. 10C is a diagram of cross-sectional view of the dual band printed antenna 10 along a direction A in FIG. 10A in an embodiment of the present invention. The dual band printed antenna 10 includes a metal substrate 1000, an electrically isolated supporting element 1002 and an inverted-F antenna element 1004.

The metal substrate 1000 includes a slot 1001 penetrating through two sides of the metal substrate 1000. In the present embodiment, the slot 1001 stretches along a specific direction, in which the specific direction is X direction. However, the present invention is not limited thereto. In the present embodiment, the slot 1001 is an open slot. More specifically, the metal substrate 1000 includes an open terminal that is open at an edge of the metal substrate 1000 and a close terminal within the metal substrate 1000.

In an embodiment, in order to maintain the structural strength of the metal substrate 1000, the slot 1001 is apart from one edge of the metal substrate 1000 by D1, in which D1 is 9 millimeters. However, the present invention is not limited thereto.

The electrically isolated supporting element 1002 is formed on the metal substrate 1000. The structure of the electrically isolated supporting element 1002 is identical to the electrically isolated supporting element 102 illustrated in FIGS. 1A-1C. As a result, the detail thereof is not described herein.

The inverted-F antenna element 1004 includes a first radiation part 1005A, a second radiation part 1005B, a third radiation part 1005C and connection radiation parts 1005D and 1005E. The second radiation part 1005B can also be grounded by using the metal ground element 1006.

The structure and operation of the first radiation part 1005A, the second radiation part 1005B, the third radiation part 1005C and the connection radiation parts 1005D and 1005E are identical the first radiation part 705A, the second radiation part 705B, the third radiation part 705C and the connection radiation parts 705D and 705E illustrated in FIGS. 7A-7C. More specifically, the first radiation part 1005A, the second radiation part 1005B, the third radiation part 1005C resonate with the slot 1001 to generate a first radiation pattern of a first frequency band and the first radiation part 1005A, the second radiation part 1005B, the third radiation part 1005C resonate themselves to generate a second radiation pattern of a second frequency band. As a result, the detail thereof is not described herein.

In an embodiment, the first frequency band has a resonant frequency of 2.4 GHz and the second frequency band has a resonant frequency of 5 GHz. More specifically, in an embodiment, the range of the first frequency band is around 2.4 GHz to 2.5 GHz. The range of the second frequency band is around 5.15 GHz to 5.875 GHz. However, the present invention is not limited thereto. When the first frequency band is around 2.4 GHz, in order to accomplish a better resonating effect between the first radiation part 1005A, the second radiation part 1005B, the third radiation part 1005C and the slot 1001, the size of the slot 1001 may include a length of 20 millimeters and a width of 2 millimeters. However, the present invention is not limited thereto.

In the present embodiment, a first terminal P1 of the first radiation part 1005A is apart from the open terminal of the slot 1001 by a length c. The feed point F is apart from the first terminal P1 and the second terminal by a length d and a length b respectively. The third radiation part 1005C has a length a. The resonant frequencies of the inverted-F antenna element 1004 in the first frequency band and the second frequency band and the corresponding impedance matching can be adjusted by adjusting the lengths described above.

More specifically, the resonant frequency of the first frequency band can be adjusted by adjusting the lengths c and a. The impedance matching of the first frequency band can be adjusted by adjusting the lengths b and d. The resonant frequency of the second frequency band can be adjusted by adjusting the lengths c and d. The impedance matching of the second frequency band can be adjusted by adjusting the length b.

Figure 11:
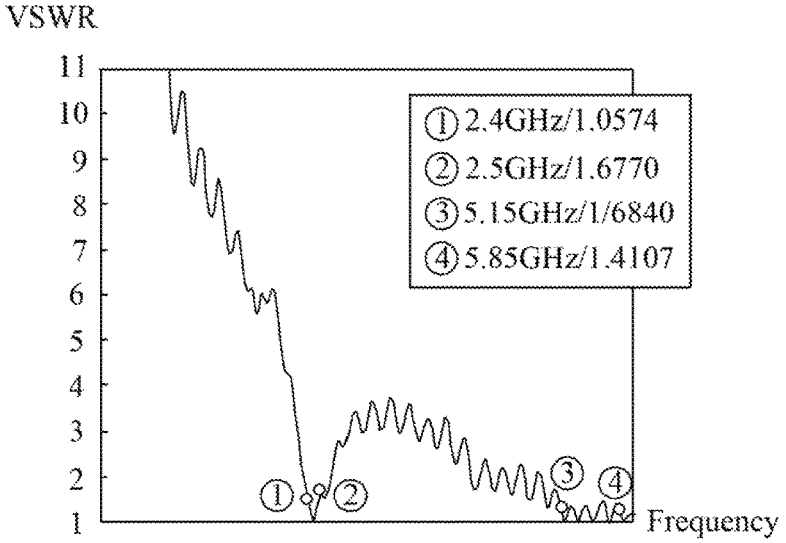
FIG. 11 is a diagram of the voltage standing wave ratio of the dual band printed antenna in an embodiment of the present invention.

Reference is now made to FIG. 11 and FIGS. 12A-12C. FIG. 11 is a diagram of the voltage standing wave ratio (VSWR) of the dual band printed antenna 10 in an embodiment of the present invention. The X-axis of the diagram stands for the frequency (unit: GHz) and the Y-axis of the diagram stands for the VSWR.

Figure 12A:
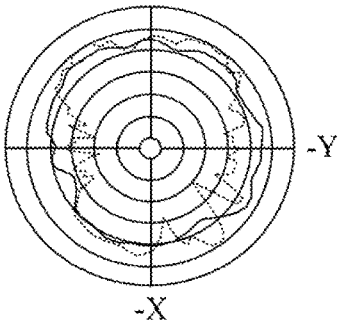
FIGS. 12A-12C are the radiation patterns of the dual band printed antenna on the X-Y plane, X-Z plane and the Y-Z plane respectively in an embodiment of the present invention.
Figure 12B:
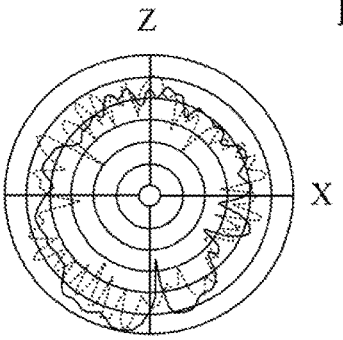
Figure 12C:
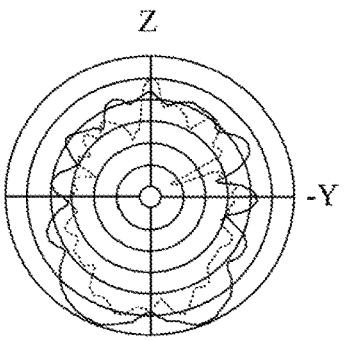

FIGS. 12A-12C are the radiation patterns of the dual band printed antenna 10 on the X-Y plane, X-Z plane and the Y-Z plane respectively in an embodiment of the present invention. The curves illustrated in thick lines are the radiation patterns of the first frequency band (2.4 GHz to 2.5 GHz) and the curves illustrated in dashed lines are the radiation patterns of the second frequency band (5.15 GHz to 5.875 GHz).

As illustrated in FIG. 11, the dual band printed antenna 10 has good VSWR performances in the first frequency band and the second frequency band. As illustrated in FIGS. 12A-12C, each of the radiation patterns of the dual band printed antenna 10 on each of planes is even.

As a result, the dual band printed antenna 10 can produce two resonant frequency bands by using the coupling of the slot 1001 having a shape of a single direction and the inverted-F antenna element 1004. The design of the slot is simplified, the structural strength and the appearance of the metal substrate 700 can be improved and the required signal transmission quality can be satisfied.

Reference is now made to FIG. 13. FIG. 13 is a diagram illustrating average antenna gains under different frequencies when different forms of slots and antenna elements are included in the dual band printed antenna in an embodiment of the present invention. In an embodiment, the average antenna gains described above is generated when a coaxial transmission line having an impedance of 50 ohms, a core diameter of 1.13 millimeters and a length of 500 millimeters is used.

When the dual band printed antenna has a open slot and an inverted-F antenna element, the antenna efficiency corresponding to the resonant frequency 2.4 of GHz is −2.9 dB to −5.1 dB. The antenna efficiency corresponding to the resonant frequency 5 of GHz is −3.7 dB to −6.2 dB.

When the dual band printed antenna has a open slot and monopole antenna element, the antenna efficiency corresponding to the resonant frequency 2.4 of GHz is −2.1 dB to −2.6 dB. The antenna efficiency corresponding to the resonant frequency 5 of GHz is −4.6 dB to −5.2 dB.

When the dual band printed antenna has a close slot and inverted-F antenna element, the antenna efficiency corresponding to the resonant frequency 2.4 of GHz is −2.9 dB to −3.4 dB. The antenna efficiency corresponding to the resonant frequency 5 of GHz is −3.5 dB to −5.5 dB.

When the dual band printed antenna has a close slot and monopole antenna element, the antenna efficiency corresponding to the resonant frequency 2.4 of GHz is −2.2 dB to −2.5 dB. The antenna efficiency corresponding to the resonant frequency 5 of GHz is −4.1 dB to −5.8 dB.

As a result, whether being in operation at the resonant frequencies of 2.4GHz or 5 GHz, the dual band printed antenna has a great performance in the antenna efficiency.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A dual band printed antenna comprising:

a metal substrate comprising a slot;

an electrically isolated supporting element, wherein a side of the electrically isolated supporting element is formed on the metal substrate; and a monopole antenna element formed on the other side of the electrically isolated supporting element and corresponding to the position of the slot, and the monopole antenna element comprises:

a radiation part comprising a feed point; and a ground part separated from the radiation part for a distance;

wherein the radiation part resonates with the slot to generate a first radiation pattern of a first frequency band and the radiation part resonates itself to generate a second radiation pattern of a second frequency band.

2. The dual band printed antenna of claim 1, wherein the slot stretches along a specific direction.

3. The dual band printed antenna of claim 2, wherein two terminals of the slot are within the metal substrate.

4. The dual band printed antenna of claim 3, wherein the radiation part and the ground part stretch along the specific direction, a first terminal and a second terminal of the radiation part are respectively apart from the two terminals of the slot by a first length and a second length that is larger than the first length, and the feed point is apart from the first terminal and the second terminal by a third length and a fourth length respectively;

wherein a first resonant frequency of the first frequency band is adjusted by adjusting the first length and the fourth length, and a first impedance matching of the monopole antenna element corresponding to the first frequency band is adjusted by adjusting the third length;

a second resonant frequency of the second frequency band is adjusted by adjusting the first length and the fourth length, and a second impedance matching of the monopole antenna element corresponding to the second frequency band is adjusted by adjusting the fourth length.

5. The dual band printed antenna of claim 3, wherein the length of the slot is 45 millimeters and the width of the slot is 2 millimeters.

6. The dual band printed antenna of claim 2, wherein the slot comprises a close terminal and an open terminal, and the open terminal is open at an edge of the metal substrate.

7. The dual band printed antenna of claim 6, wherein the radiation part and the ground part stretch along the specific direction, a first terminal of the radiation part that is closer to the open terminal of the slot is apart from the open terminal by a first length and the feed point is apart from the first terminal and a second terminal of the radiation part by a second length and a third length respectively;

wherein a first resonant frequency of the first frequency band is adjusted by adjusting the first length and the third length, and a first impedance matching of the monopole antenna element corresponding to the first frequency band is adjusted by adjusting the second length;

a second resonant frequency of the second frequency band is adjusted by adjusting the first length and the third length, and a second impedance matching of the monopole antenna element corresponding to the second frequency band is adjusted by adjusting the second length.

8. The dual band printed antenna of claim 6, wherein the length of the slot is 20 millimeters and the width of the slot is 2 millimeters.

9. The dual band printed antenna of claim 1, wherein the electrically isolated supporting element comprises an electrically isolated supporting layer and a circuit board layer adjacent to each other, the electrically isolated supporting layer is disposed on the metal substrate, the circuit board layer is disposed at a side of the electrically isolated supporting layer opposite to the metal substrate and the monopole antenna element is disposed at a side of the circuit board layer opposite to the electric ally isolated supporting layer.

10. The dual band printed antenna of claim 9, wherein the thickness of the electrically isolated supporting layer is 1 millimeter and the thickness of the circuit board is 0.4 millimeters.

11. The dual band printed antenna of claim 1, further comprising a metal ground element to be electrically coupled to the ground part and the metal substrate to aid the ground part to be grounded.

12. A dual band printed antenna comprising:

a metal substrate comprising a slot;

an electrically isolated supporting element formed on a side of the metal substrate; and an inverted-F antenna element formed on the other side of the electrically isolated supporting element and corresponding to the position of the slot, and the inverted-F antenna element comprises at least one radiation part comprising a feed point and a ground point;

wherein the radiation part resonates with the slot to generate a first radiation pattern of a first frequency band and the radiation part resonates itself to generate a second radiation pattern of a second frequency band.

13. The dual band printed antenna of claim 12, wherein the slot stretches along a specific direction.

14. The dual band printed antenna of claim 13, wherein the inverted-F antenna further comprises:

a first radiation part stretching along the specific direction and comprising the feed point;

a second radiation part stretching along the specific direction, disposed at a first side of the first radiation part, being parallel and adjacent to the first radiation part, apart from the first radiation part by a first distance and comprising the ground point;

a third radiation part stretching along the specific direction, disposed at a second side of the first radiation part, being parallel and adjacent to the first radiation part and apart from the first radiation part by a second distance; and two connection radiation parts electrically coupling a terminal of the second radiation part to the first radiation part and electrically coupling the other terminal of the second radiation part to the third radiation part.

15. The dual band printed antenna of claim 14, wherein two terminals of the slot are within the metal substrate.

16. The dual band printed antenna of claim 15, wherein a first terminal and a second terminal of the first radiation part are respectively apart from two terminals of the slot by a first length and a second length that is larger than the first length, the feed point is apart from the first terminal and the second terminal by a third length and a fourth length respectively and the third radiation part has a fifth length;

wherein a first resonant frequency of the first frequency band is adjusted by adjusting the first length and the fifth length, and a first impedance matching of the inverted-F antenna element corresponding to the first frequency band is adjusted by adjusting the third length and the fourth length;

a second resonant frequency of the second frequency band is adjusted by adjusting the first length and the third length, and a second impedance matching of the inverted-F antenna element corresponding to the second frequency band is adjusted by adjusting the fourth length.

17. The dual band printed antenna of claim 13, wherein the slot comprises a close terminal and an open terminal, and the open terminal is open at an edge of the metal substrate.

18. The dual band printed antenna of claim 17, wherein a first terminal of the first radiation part is apart from the open terminal of the slot by a first length, the feed point is apart form the first terminal and a second terminal of the first radiation part by a second length and a third length respectively, and the third radiation part has a fourth length;

wherein a first resonant frequency of the first frequency band is adjusted by adjusting the first length and the fourth length, and a first impedance matching of the inverted-F antenna element corresponding to the first frequency band is adjusted by adjusting the second length and the third length;

a second resonant frequency of the second frequency band is adjusted by adjusting the first length and the second length, and a second impedance matching of the inverted-F antenna element corresponding to the second frequency band is adjusted by adjusting the third length.

19. The dual band printed antenna of claim 12, wherein the electrically isolated supporting element comprises an electrically isolated supporting layer and a circuit board layer adjacent to each other, the electrically isolated supporting layer is disposed at a side of the metal substrate, the circuit board is disposed at an opposite side of the metal substrate and the inverted-F antenna element is disposed at one side of the circuit board opposite to the electrically isolated supporting layer.

20. The dual band printed antenna of claim 12, further comprising a metal ground element to be electrically coupled to the ground part and the metal substrate to aid the ground part to be grounded.

* * * * *